US006047076A

United States Patent [19]

Yang

[11] Patent Number: 6,047,076

[45] Date of Patent: Apr. 4, 2000

[54] EARPHONE-MICROPHONE SYSTEM HAVING DOUBLE EAR BRACES

[75] Inventor: Bill Yang, Taipei, Taiwan

[73] Assignee: Cotron Corporation, Taipei, Taiwan

[21] Appl. No.: 09/313,165

[22] Filed: May 17, 1999

[30] Foreign Application Priority Data

Apr. 29, 1999 [TW] Taiwan ..... 88206727

[51] Int. Cl.[7] ..... H04R 25/00

[52] U.S. Cl. ..... 381/381; 381/370; 381/374; 381/379; 181/129

[58] Field of Search ..... 381/381, 370, 381/374, 375, 330, 71.6, FOR 149, FOR 150, 371, 376, 377, 379, 383; 181/128, 129, 137

[56] References Cited

U.S. PATENT DOCUMENTS 0,466,725 1/1892 Miltimore ..... 181/137
5,881,161 3/1999 Liu ..... 381/381

FOREIGN PATENT DOCUMENTS 48210 10/1982 United Kingdom ..... 381/149

*Primary Examiner*—Huyen Le
*Assistant Examiner*—Suhan Ni
*Attorney, Agent, or Firm*—Jiawei Huang; J.C. Patents

[57] ABSTRACT

An earphone-microphone set that has a pair of adjustable ear braces. The earphone-microphone set includes an earphone housing for enclosing the earphone. There is a shallow groove around the outer edge of the housing and a cable latch positioned vertically at each end of the groove. A hole is also drilled beside each of the cable latch. A microphone capable of rotating is attached to the earphone housing. One end of a signal transmission cable is connected to the earphone. The cable comes out from the edge of the earphone housing around its mid-section. The other end of the cable is connected to a plug. An upper ear-brace-adjusting pin and a lower ear-brace-adjusting pin are inserted into the respective upper circular hole and the lower circular hole beside the cable latches. The upper and the lower ear-brace-adjusting pin also passes through an upper ear brace and a lower ear brace so that each ear brace can slide up or down independently. Consequently, distance of separation between the two braces can be adjusted to fit whatever ear size a user may have.

8 Claims, 9 Drawing Sheets

EARPHONE-MICROPHONE SYSTEM HAVING DOUBLE EAR BRACES

CROSS-REFERENCE TO RELATED APPLICATION

This application claims the priority benefit of Taiwan application Ser. No. 88206727, filed Apr. 29, 1999, the full disclosure of which is incorporated herein by reference.

BACKGROUND OF THE INVENTION

1. Field of Invention

The present invention relates to an earphone structure. More particularly, the present invention relates to an ergonomically designed earphone structure for human ear.

2. Description of Related Art

Personal audio systems are popular everywhere these days. Audio systems can provide users various kinds of entertainment while they are engaged in all sorts of activities. People can listen to radio broadcasting, cassette tapes or optical disk any time they want. The most common type of audio system has stereo earphones for both ears or a single earphone for just one ear. In general, the earphone is attached to the human ear so that a user can listen to the sound produced by the system without disturbing others. One further advantage of listening with an earphone is the good quality of sound that can be provided to its user. The user is able to receive clear sound or voice signals with very little background noise as cannot be done with any sound system that transmits sound through the air. Hence, listening can still be carried on even when a user is exercising or engaged in activities in a noisy environment. In addition, earphones are often used in an environment that involves two-way communication such as lecturing, or telephone and wireless communication. In fact, when two-way communication is required, a microphone is usually attached to the earphone and extended towards user's mouth so that communication can carry on without using either hand.

FIGS. 1A and 1B are sketches showing the respective front and back portions of a conventional earphone-microphone set having just a single ear brace. As shown in FIGS. 1A and 1B, the earphone-microphone set 100 includes an earphone body 102, an ear brace 104, a microphone 106, a signal transmission cable 108 and a plug 110. The ends of ear brace 104 are inserted into holes 102*a* and 102*b* of the earphone body 102 such that the ear brace 104 can rotate about earphone body 102. The ear brace 104 has a roughly triangular shape specially designed for mounting onto a user's ear. In general, the ear brace 104 is made from some hard plastic material. A microphone 106 is also attached to the earphone body 102. The microphone 106 is attached in such a way that rotation of the microphone 106 relative to the earphone body 102 is possible.

As shown in FIG. 1A the tip of the microphone is able to sweep out an angle Φ upward or downward with respect to the central line Z. Hence, the microphone 106 can be adjusted to a level that fits the talking position of the user no matter if the earphone set is worn on the left or the right ear. The signal transmission cable 108 comes out through the earphone body 102 near position B.

In summary, the ear brace structure of a conventional earphone-microphone set is usually worn around the periphery of the ear. Since the ear brace is usually formed from hard plastic material, the user may feel discomfort after wearing the earphone for a while because the human ear is a soft and fleshy organ.

Furthermore, a conventional ear brace has a fixed triangular structure. Therefore, the ear brace can hardly match the shape of each individual ear. For example, when the user's ear is big, the ear has to be squeezed into the ear brace. On the other hand, if the user's ear is small, the ear brace can barely grip the ear at all, and the earphone can easily slip off the ear.

In addition, the signal transmission cable of a convention earphone system normally comes out horizontally near the edge of the earphone body. Consequently, when the signal line is accidentally pulled, the earphone can easily come off, causing great inconvenience to the user.

In light of the foregoing, there is a need to provide an earphone-microphone set that has a pair of adjustable ear braces.

SUMMARY OF THE INVENTION

The present invention provides an earphone-microphone set having a pair of ear braces such that the pair of ear braces can be adjusted to fit the ear size for a range of people.

The invention provides an earphone-microphone set having a pair of ear braces such that the ear braces are fabricated using soft material rather than hard material so that the earphone wearer may feel more comfortable.

The invention provides an earphone-microphone set having a pair of ear braces such that the signal transmission cable is specially routed to prevent the earphone from coming off the ear so readily due to an accidental pull.

To achieve these and other advantages and in accordance with the purpose of the invention, as embodied and broadly described herein, the invention provides an earphone-microphone set that has a pair of ear braces. The earphone-microphone set comprises an earphone housing, a microphone, a signal transmission cable, a plug, a pair of ear-brace-adjusting pins, a first ear brace and a second ear brace. The ear housing is used to accommodate an earphone. A shallow groove is formed around the edge of the ear housing with a cable latch at each end of the groove. The cable latches are positioned vertically on each side of the earphone housing. The microphone is coupled to the earphone housing in such a way that rotation is possible. Hence, the microphone can be adjusted to a level suitable for talking when the earphone is worn. One end of the signal transmission cable is connected to the earphone. The transmission cable comes out of the earphone housing near the edge along a mid-horizontal line. The plug is connected to the other end of the signal transmission cable. The plug can be plugged into the jack of any appropriate electronic devices. One of the ear-brace-adjusting pins passes through the first ear brace and then inserts into the upper hole of the earphone housing. The other ear-brace-adjusting pin passes through the second ear brace and then inserts into the lower hole of the earphone housing. Therefore, the first brace and the second brace are each capable of sliding up and down relative to the ear-brace-adjusting pin. Therefore, the earphone-microphone set can be adjusted to fit the ear size for any user by simply sliding the first and the second ear brace up or down relative to the pins.

The first and the second ear brace are made from a soft material in order to provide greater comfort to the earphone user. Furthermore, an end cap is attached to the end of each ear-brace-adjusting pin for restraining the ear braces. Hence, not only can the earphone be worn on the left ear or the right ear, but the earphone can also be adjusted to fit the ear of almost any user, as well. In addition, the signal transmission cable is specially positioned around the earphone housing to prevent the earphone from coming off due to an accidental pull.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1A:
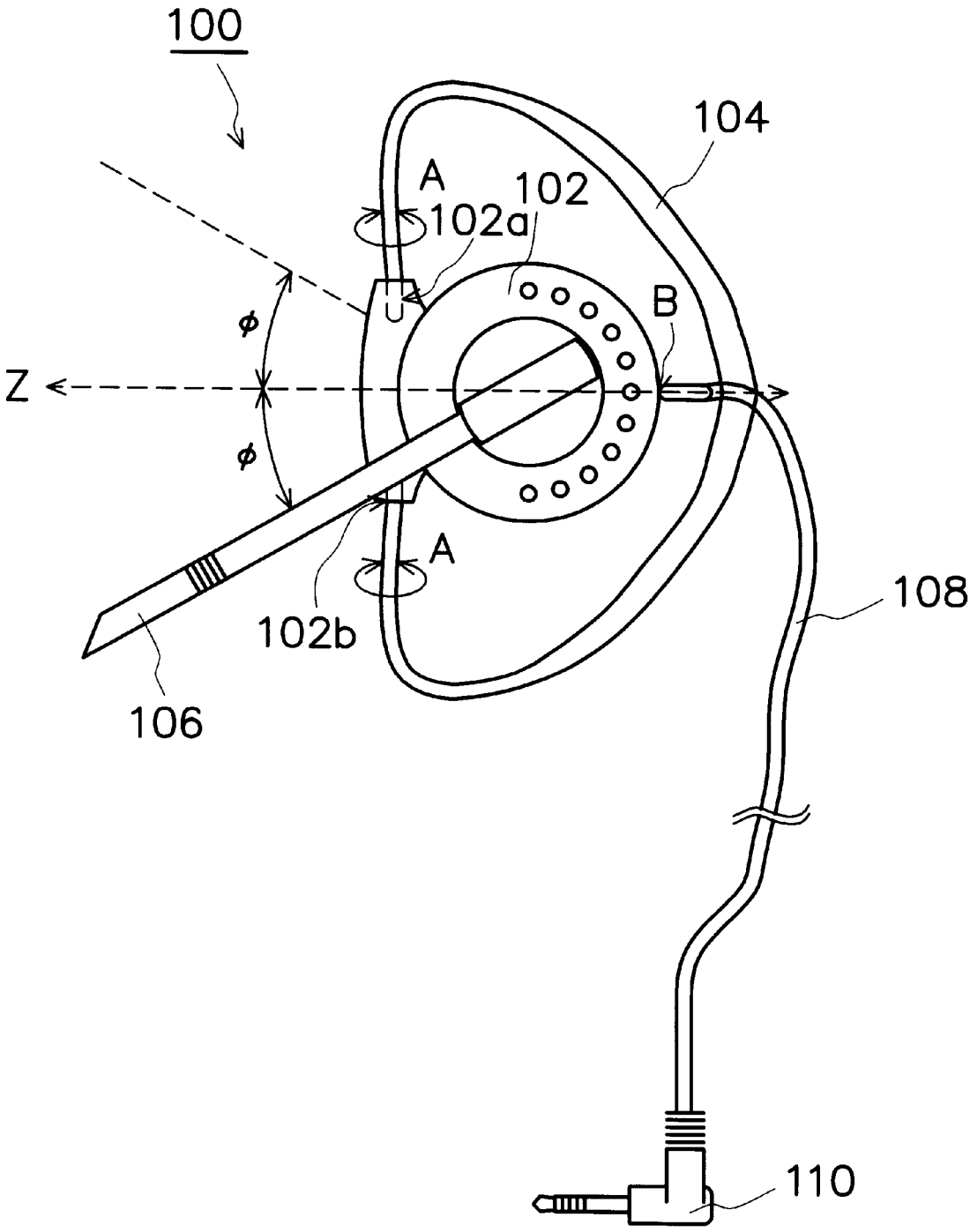
FIG. 1A (PRIOR ART)
FIGS. 1A and 1B are sketches showing the respective front and back portion of a conventional earphone-microphone set having just a single ear brace.
Figure 1B:
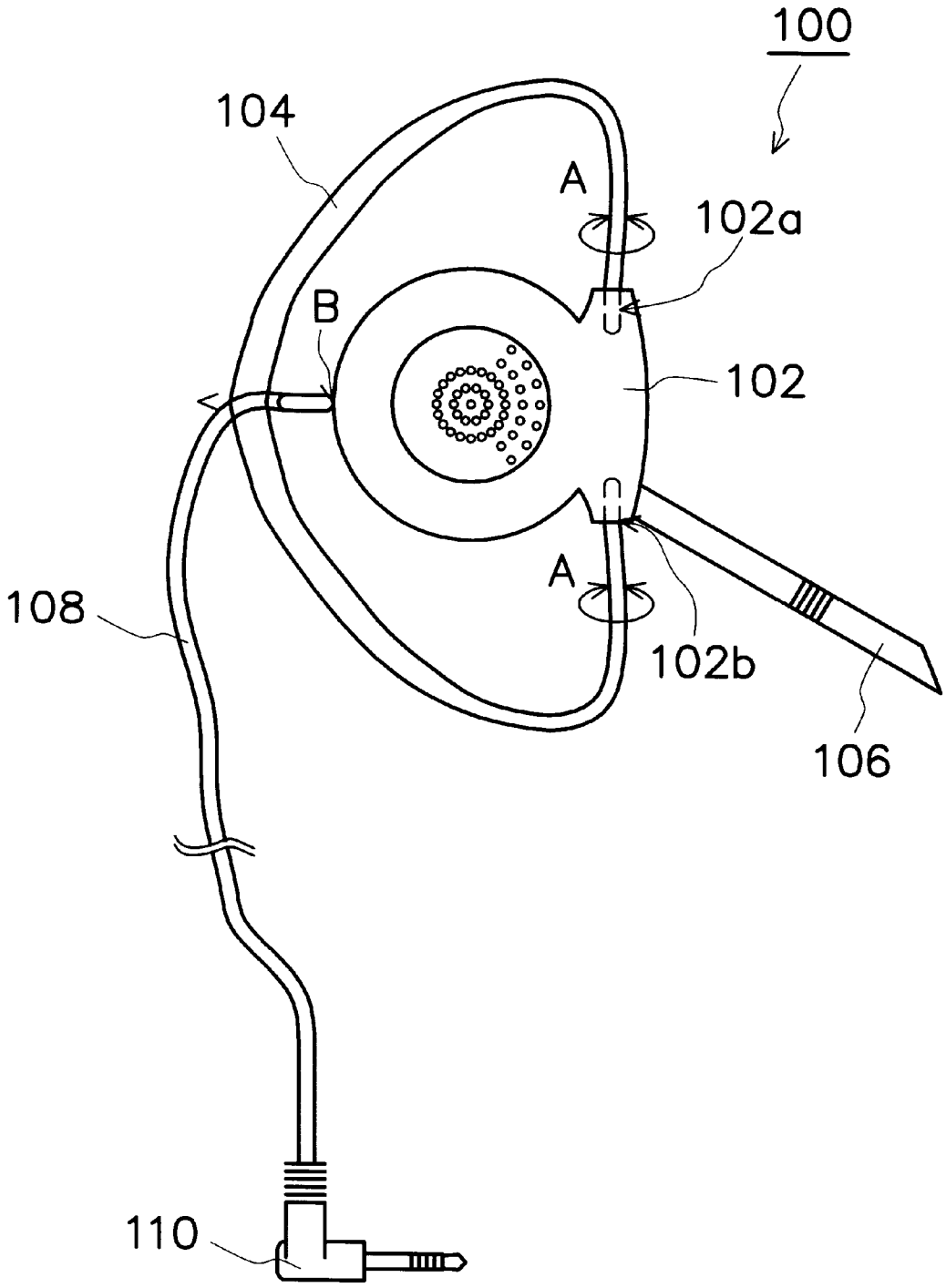
FIG. 1B (PRIOR ART)

Reference will now be made in detail to the present preferred embodiments of the invention, examples of which are illustrated in the accompanying drawings. Wherever possible, the same reference numbers are used in the drawings and the description to refer to the same or like parts.

Figure 2A:
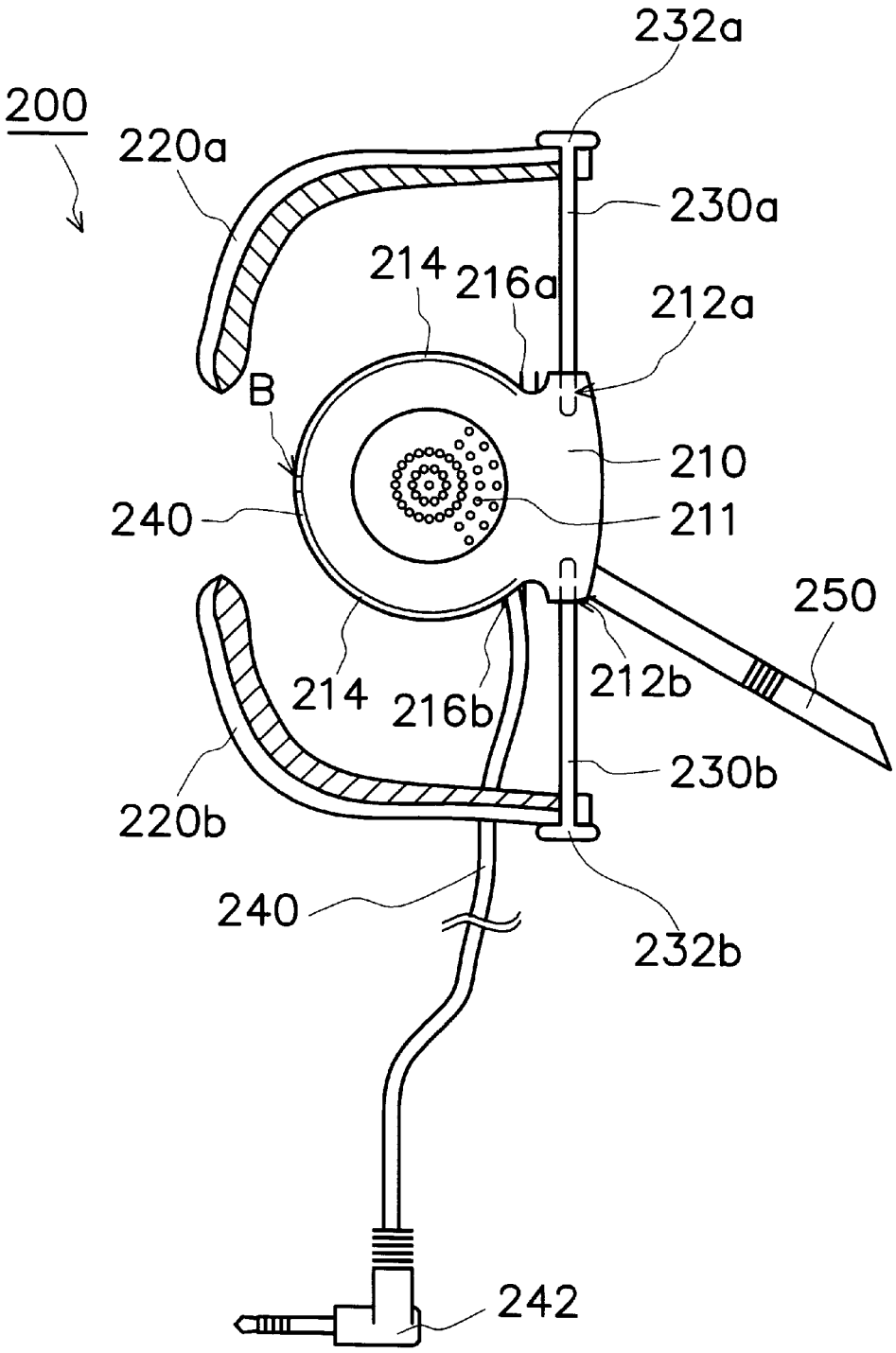
FIGS. 2A and 2B are sketches showing the respective front and back portion of an earphone-microphone set having a pair of adjustable ear braces according to this invention.
Figure 2B:
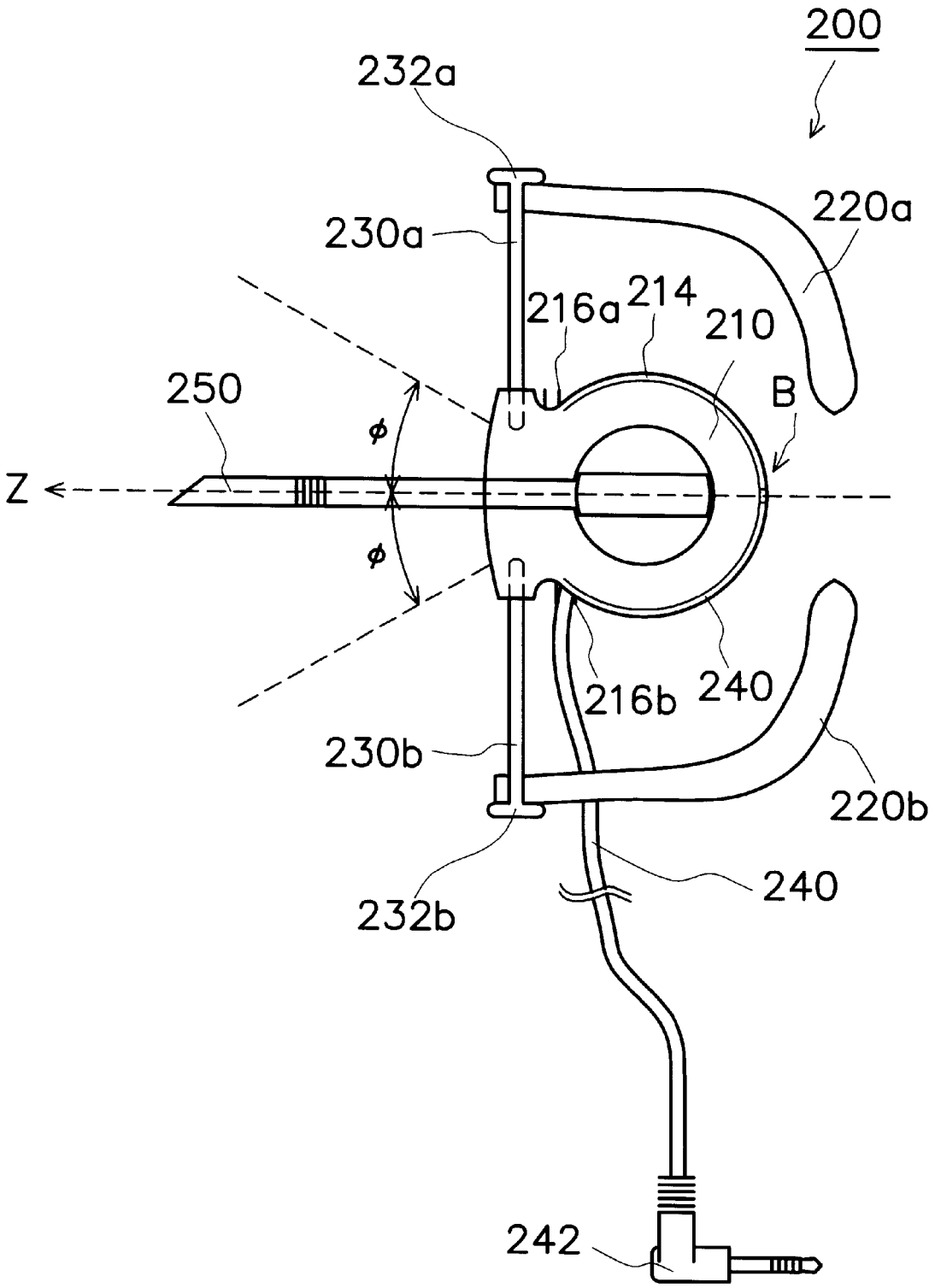

FIGS. 2A and 2B are sketches showing the respective front and back portion of an earphone-microphone set having a pair of adjustable ear braces according to this invention. As shown in FIGS. 2A and 2B, the earphone-microphone set 200 includes an earphone housing 210, two earphone braces 220*a* and 220*b*, two cylindrical ear-brace-adjusting pins 230*a* and 230*b*, a signal transmission cable 240 and a plug 242. The earphone housing 210 is used for enclosing an earphone 211. The outer edge of the earphone housing 210 has a shallow groove 214 with a pair of cable latches 216*a* and 216*b* positioned vertically at the end of the groove 214. A pair of holes 212*a* and 212*b* is also formed beside the cable latches 216*a* and 216*b*, respectively. The microphone 250 is capable of rotating and is attached to the earphone housing 210, as shown in FIG. 2B. The maximum swing of the microphone 250 up and down from the Z-axis is about Φ. Hence, the microphone 250 can be adjusted to a level suitable for talking whether the earphone-microphone set is worn on the left or the right ear. One end of the signal transmission cable 240 is connected to the earphone coming out the edge of the earphone housing 210 near the central position B. The other end of the signal transmission cable 240 is connected to the plug 242. The plug 242 can be plugged into the jack of any piece of audio equipment such as a mobile cellular telephone, a stereo radio or multimedia computer system. The cylindrical ear-brace-adjusting pins 230*a* and 230*b* are inserted into the upper circular hole 212*a* and the lower circular hole 212*b* of the earphone housing 210.

In addition, the cylindrical ear-brace-adjusting pins 230*a* and 230*b* are capable of rotating relative to the earphone housing 210. The upper ear-brace-adjusting pin 230*a* and the lower ear-brace-adjusting pin 230*b* also pass through the first ear brace 220*a* and the second ear brace 220*b* respectively. Therefore, the first ear brace 220*a* and the second ear brace 220*b* can independently slide up and down relative to the respective cylindrical ear-brace-adjusting pins 230*a* and 230*b*. Consequently, the ear braces 220*a* and 220*b* can be adjusted to fit ears of almost any size.

The first and the second ear braces 220*a* and 220*b* are made from a soft material so that the user can wear the earphone-microphone set 200 for some time without feeling discomfort. In addition, the shape and size of the ear braces 220*a* and 220*b* can be identical or slightly dissimilar. The earphone-microphone set 200 further includes end caps 232*a* and 232*b* attached to the respective ends of the ear-brace-adjusting pins 230*a* and 230*b*. The end caps 232*a* and 232*b* are stoppers that prevent the ear braces 220*a* and 220*b* from falling off.

Since the ear braces 220*a* and 220*b* are capable of relative moving up and down along the ear-brace-adjusting pins 230*a* and 230*b*, the earphone-microphone set 200 can be made to fit whatever ear size a user may have. Furthermore, since the ear-brace-adjusting pins 230*a* and 230*b* are able to rotate about the earphone housing 210, the earphone-microphone set 200 can be worn on the left or the right ear of the user. For example, if a user wants to wear the earphone-microphone set 200 on the left ear, the user could put the ear braces 220*a* to fit the upper rim of the left ear, and adjust the ear braces 220*a* and 220*b* to fit the whole rim of the left ear. When the user plans to wear the earphone-microphone set 200 on the right ear, the user could respectively rotate the ear braces 220*a* and 220*b* along the ear-brace-adjusting pins 230*a* and 230*b* by about 180 degrees, by which the ear braces 220*b* can easily hang on the upper rim of the right year; furthermore, the user adjusts the ear braces 220*a* and 220*b* to fit the whole rim of the right ear. Moreover, the user could redirect the microphone 250 to meet the condition of right ear. In addition, the ear-brace-adjusting pins 230*a* and 230*b* are situated on one side of the earphone housing 210 so that no interference will occure when rotate the ear braces 220*a* and 220*b*.

Figure 3:
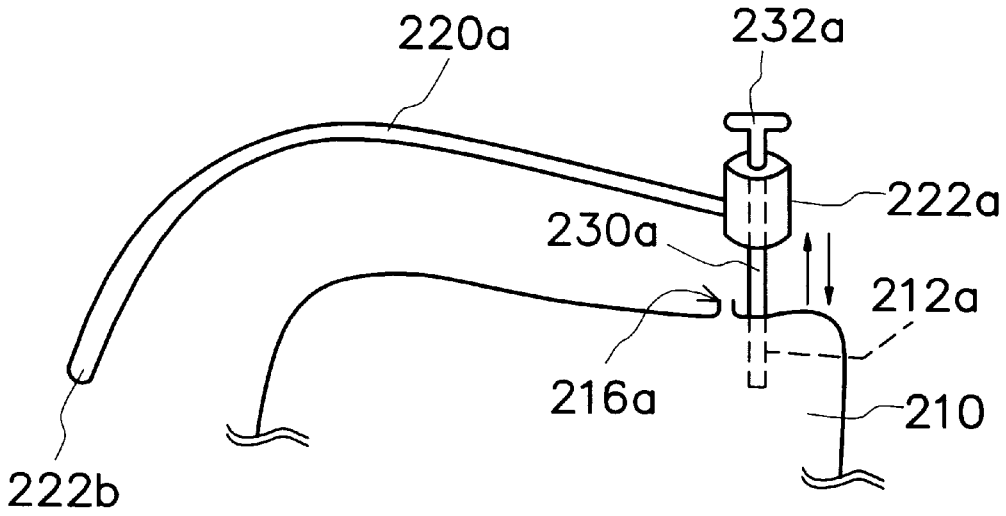
FIG. 3 is a simplified diagram showing an ear brace and the possible movement of the ear brace along the ear-brace-adjusting pin for the earphone-microphone set of this invention.

FIG. 3 is a schematic diagram for showing an ear brace and the possible movement of the ear brace along the ear-brace-adjusting pin for the earphone-microphone set of this invention. As shown in FIG. 3, an ear brace 220*a* can be subdivided into two sections 222*a* and 222*b*. Section 222*a* of the ear brace 220*a* slips into the ear-brace-adjusting pin 230*a* so that the ear brace 220*a* can slide up and down the ear-brace-adjusting pin 230*a* to grip an ear snugly.

Figure 4A:
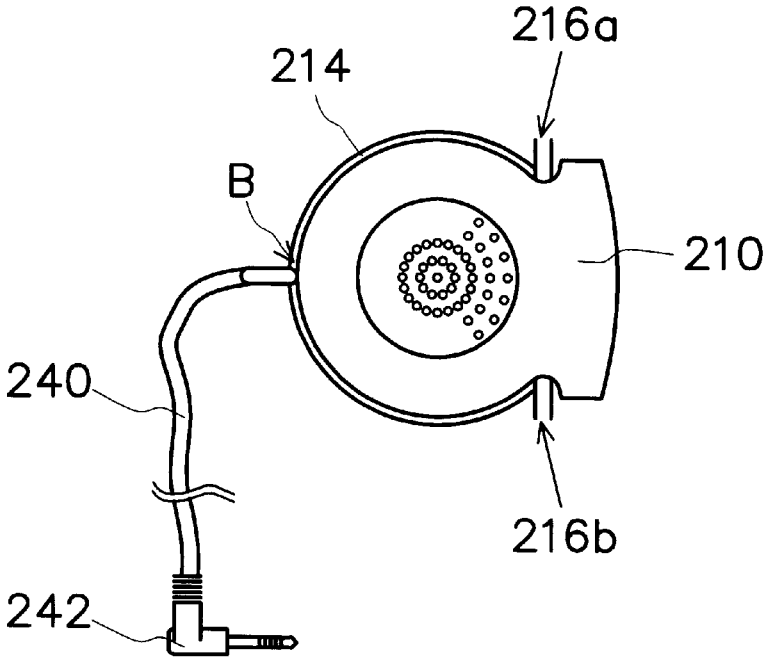
FIGS. 4A and 4B are diagrams showing a shallow groove near the edge of the earphone housing as well as the position of a signal transmission cable according to the earphone-microphone set of this invention.
Figure 4B:
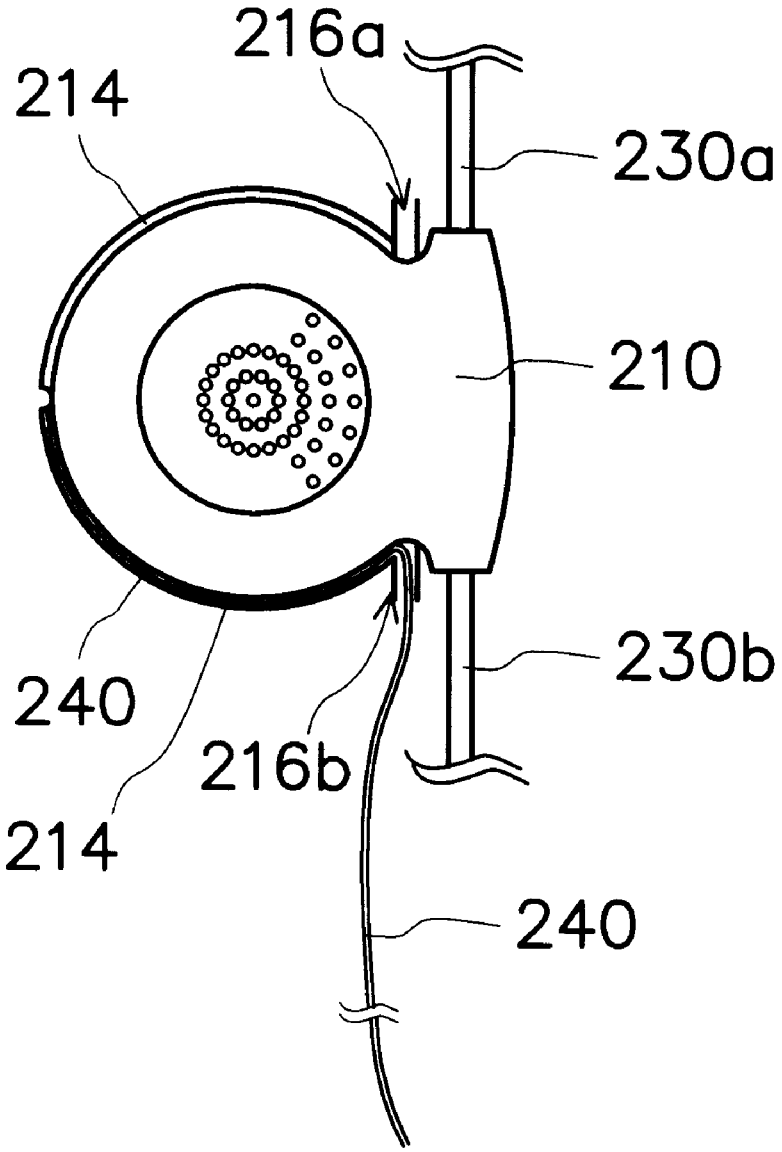

FIGS. 4A and 4B are diagrams showing a shallow groove near the edge of the earphone housing as well as the position of a signal transmission cable according to the earphone-microphone set of this invention. In FIG. 4A, the signal transmission cable 240 is loosely attached to the earphone housing 210. The signal transmission cable 240 comes out of the edge of the earphone housing 210 in a central position B. In FIG. 4B, the signal transmission cable 240 is pushed into the shallow groove 214 that runs around the edge of the earphone housing 210. Because the width of the shallow groove 214 is almost identical to the width of the cable 240, the cable 240 fits tightly in the groove 214. Then, the signal transmission cable 240 is latched onto the cable latch 216*b* on the earphone housing 210 beside the ear-brace-adjusting pin 230*b*. The function of latching the cable 240 onto the cable latch 216*b* is to prevent the earphone from falling off when the cable 240 is accidentally pulled.

Figure 5:
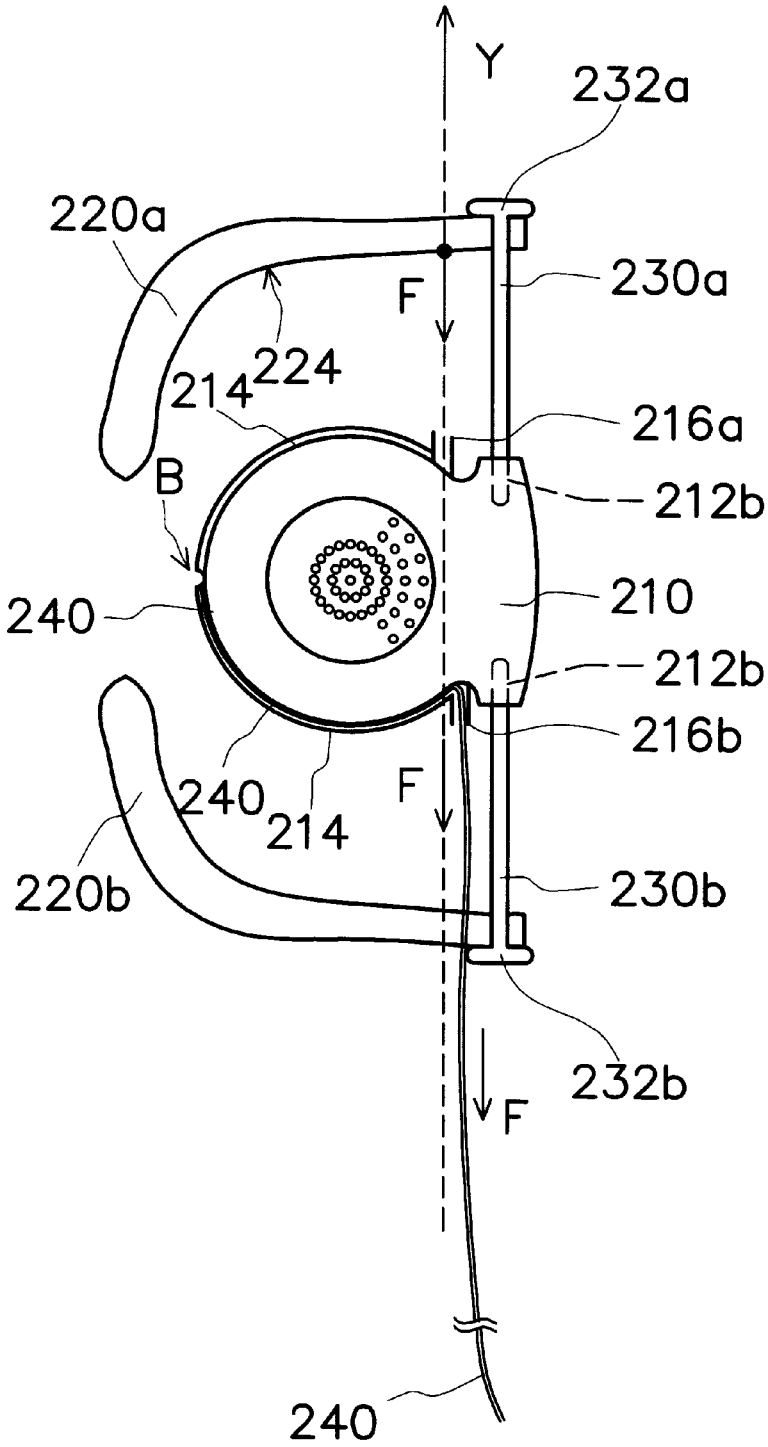
FIG. 5 is a diagram showing the distribution of forces on the earphone housing when the signal transmission cable leading to earphone-microphone set of this invention is accidentally pulled.

FIG. 5 is a diagram showing the distribution of forces on the earphone housing when the signal transmission cable leading to earphone-microphone set of this invention is accidentally pulled. The signal transmission cable 240 still comes out of the edge of the earphone housing 210 in a central position B. However, the signal transmission cable 240 is pushed into the shallow groove 214 that runs around the edge of the earphone housing 210 and latched onto the cable latch 216*b*. When the earphone set is accidentally pulled by the cable 240, a forward force F is exerted on the earphone in a direction along the dashed line Y. At the same time, the earphone housing 210 and the ear brace 220*a* also receives a pulling force F in the Y-direction. Since the ear brace 220*a* is pulled in the Y-direction, user's ear can provide a force counteracting the pull. Hence, the earphone set is prevented from being pulled off. Because the ear brace 220*a* is made from a soft material, the ear will be cushioned against the pull.

Therefore, the invention is able to improve wearing comfort and tightness of grip for the user.

Figure 6A:
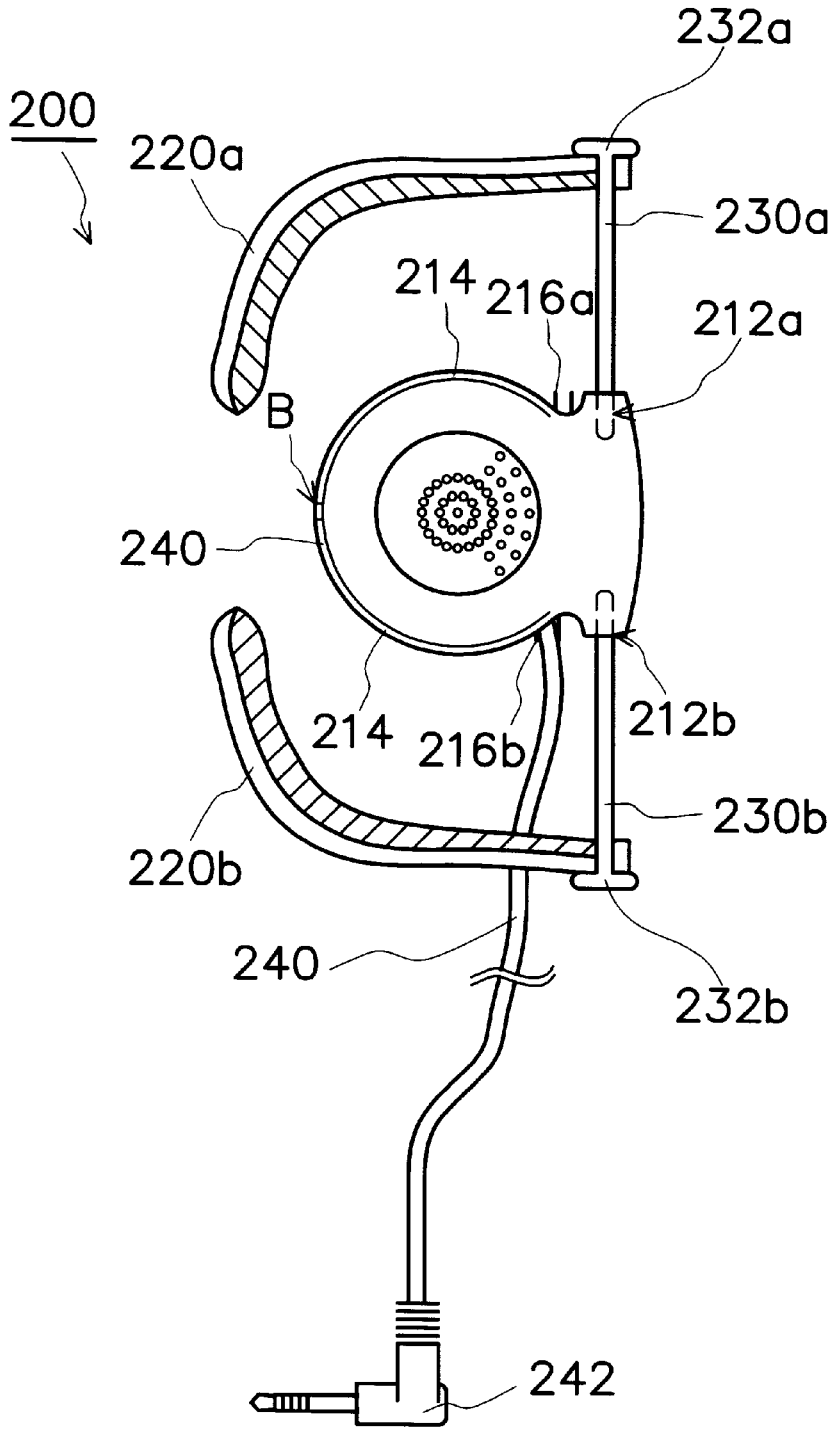
FIGS. 6A and 6B are sketches showing the respective front and back portion of an earphone set having a pair of adjustable ear braces according to this invention.
Figure 6B:
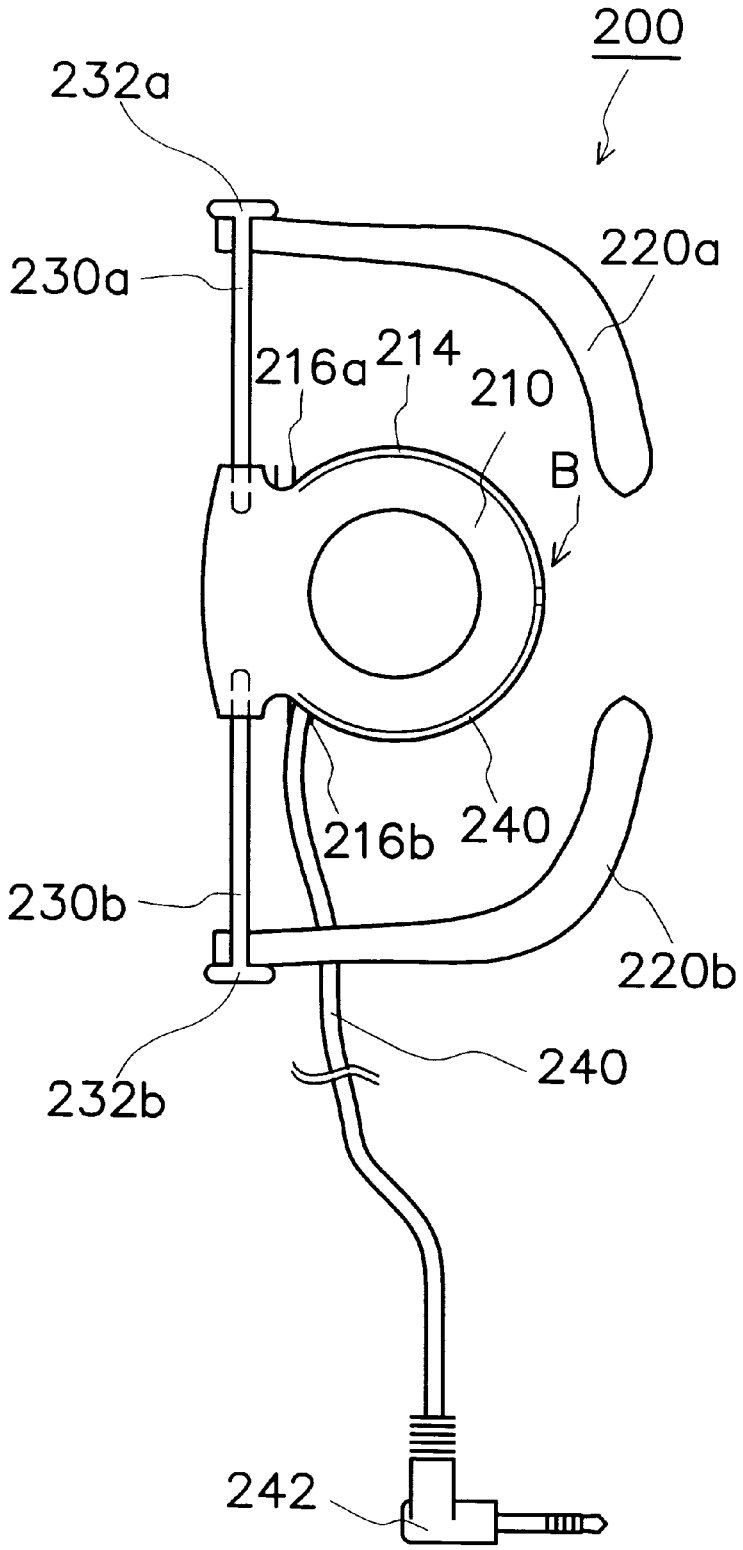

FIGS. 6A and 6B are sketches showing the respective front and back portion of an earphone set having a pair of adjustable ear braces according to this invention. The only structural difference between this earphone set and the one in FIGS. 2A and 2B is the deletion of the microphone. Since the functions of various components have been described using FIGS. 2A and 2B before, detailed description is not repeated here.

In summary, advantages of using the earphone-microphone set having a pair of ear braces set of this invention over a conventional earphone-microphone at least include:

1. Since two ear braces which can respectively slide along the ear-brace-adjusting pins are used instead of one, the earphone set can fit into a user's ear more easily and comfortably no matter the user's ear size.

2. Since two ear braces which can respectively rotate along the ear-brace-adjusting pins are used instead of one, the earphone set can easily fit a user's left or right ear.

3. Since soft material is used to fabricate the ear braces, the user can use the earphone set more comfortably.

4. The earphone set rest on the peripheral section of the ear unlike earplugs that are pushed right into the ear. Hence, the earphone set is more comfortable for the user.

5. The signal transmission cable can be embedded inside a groove that runs around the edge of the earphone housing and then gripped firmly by a cable latch. Therefore, the earphone set is not easily dislodged from the ear, even when the cable is accidentally pulled.

6. The microphone can be rotated up and down from a horizontal line relative to the earphone housing. Hence, the earphone-microphone set can be worn on the left or the right ear.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An earphone-microphone set that has a pair of adjustable ear braces, comprising:

an earphone housing for enclosing an earphone, with a groove running around the edge of the housing and a cable latch at each end of the groove, the housing further including a circular hole beside each cable latch;

a microphone attached to the earphone housing capable of rotation;

a signal transmission cable, one end of which is connected to the earphone, with the cable coming out at the edge of the housing near its mid-section;

a plug connected to the other end of the signal transmission cable;

a pair of ear-brace-adjusting pins inserted into the respective upper and lower circular holes, each ear-brace-adjusting pin being capable of rotation; and a first ear brace and a second ear brace each of which slides into an ear-brace-adjusting pin so that distance of separation between the first and the second ear brace is variable so as to fit user's ear size.

2. The earphone-microphone set of claim 1, wherein both the first ear brace and the second ear brace are made from a soft material.

3. The earphone-microphone set of claim 1, wherein the ear-brace-adjusting pin is cylindrical.

4. The earphone-microphone set of claim 1, wherein the earphone-microphone set further includes a pair of end caps such that each end cap is attached to one end of the ear-brace-adjusting pin for restraining the first or the second ear brace from moving away from the pin.

5. An earphone set having a pair of adjustable ear braces, comprising:

an earphone housing for enclosing an earphone, with a groove running around the edge of the housing and a cable latch at each end of the groove, the housing further including a circular hole beside each cable latch;

a signal transmission cable the cable coming out of the edge of the housing near its mid-section, one end of which cable is connected to the earphone;

a plug connected to the other end of the signal transmission cable;

a pair of ear-brace-adjusting pins inserted into the respective upper and lower circular holes, each ear-brace-adjusting pin being capable of rotation; and a first ear brace and a second ear brace each of which slides into an ear-brace-adjusting pin so that distance of separation between the first and the second ear brace is variable so as to fit user's ear size.

6. The earphone set of claim 5, wherein both the first ear brace and the second ear brace are made from a soft material.

7. The earphone set of claim 5, wherein the ear-brace-adjusting pin is cylindrical.

8. The earphone set of claim 5, wherein the earphone set further includes a pair of end caps such that each end cap is attached to one end of the ear-brace-adjusting pin for restraining the first or the second ear brace from moving away from the pin.

* * * * *